United States Patent [19]

Eisermann

[11] Patent Number: 4,658,612

[45] Date of Patent: Apr. 21, 1987

[54] FLEXIBLE STRIP KEY

[75] Inventor: Armin Eisermann, Velbert, Fed. Rep. of Germany

[73] Assignee: Schulte-Schlagbaum Aktiengesellschaft, Velbert, Fed. Rep. of Germany

[21] Appl. No.: 743,181

[22] Filed: Jun. 10, 1985

[30] Foreign Application Priority Data

Jun. 9, 1984 [DE] Fed. Rep. of Germany ... 8417687[U]

[51] Int. Cl.[4] ..... E05B 19/02; E05B 19/26

[52] U.S. Cl. ..... 70/402; 70/413

[58] Field of Search ..... 70/457, 458, 413, 407, 70/402, 405, 396; D8/347, 348; D11/3, 4, 5; 63/1 R, 3

[56] References Cited

U.S. PATENT DOCUMENTS

| | | | |
|---|---|---|---|
| 2,361,506 | 10/1944 | Smith | 70/458 |
| 2,931,953 | 4/1960 | Barney | 70/413 |
| 3,654,783 | 4/1972 | Sinclair | 70/407 |
| 4,079,606 | 3/1978 | Svihovec | 70/407 |

FOREIGN PATENT DOCUMENTS 7045397 12/1970 Fed. Rep. of Germany .

*Primary Examiner*—Robert L. Wolfe

*Attorney, Agent, or Firm*—Martin A. Farber

[57] ABSTRACT

A waterproof key, particularly for locks of bath-house locker doors, which can be worn on the arm of a bathing guest, comprising a strip of material having an opening code. The material is sufficiently flexible to permit the strip to be bent to form an arm band of different diameter for encircling the arm of a wearer.

10 Claims, 6 Drawing Figures

4
4
C
9
1
9
8
8
2

4
4
3
C
1
x
E
E
8
8
9
y
St 10
12
a
a
11
15
15
14
a
a
13
4
9
1
3
9
8
9

10
12
11
14
13

A
1
10
11
9

Fig.5
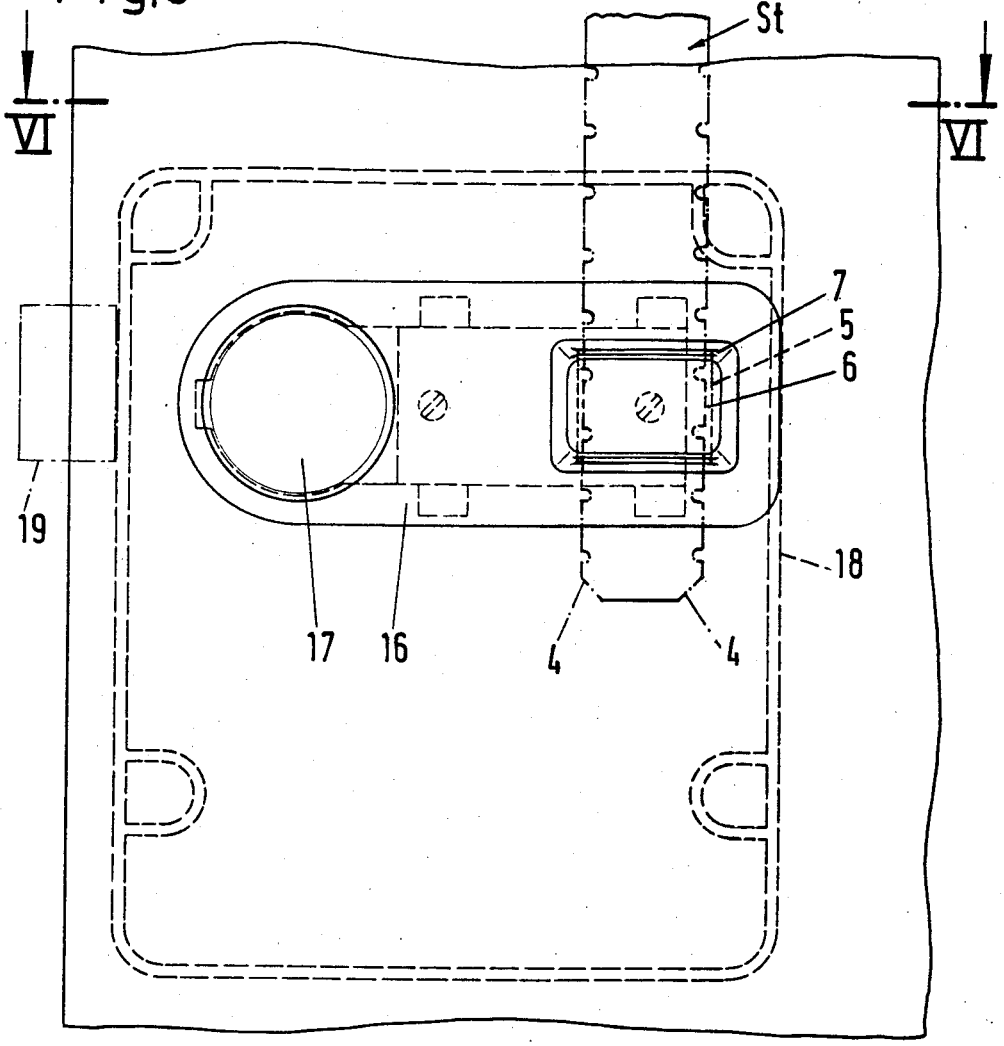
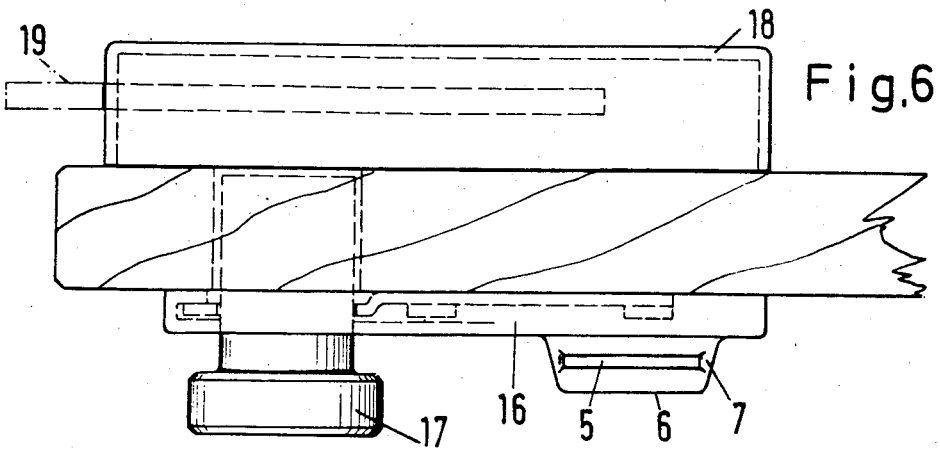
Fig.6

FLEXIBLE STRIP KEY

FIELD AND BACKGROUND OF THE INVENTION

The present invention relates to a waterproof key, particularly for locks of bathhouse locker doors, which can be worn on the arm or the like of, in particular, bathing guests.

A key of this kind is known, for instance, from Federal Republic of Germany Utility Model 70 45 397. The arm band which bears the key has a closure buckle whose pin itself creates the corresponding pin hole for itself. A special carrier is provided for the key. The carrier is developed as a pocket. Its wide side wall of larger area has passage slots and can thus be pushed onto the arm band. The pocket holds the waterproof key in position transverse to the direction of the band, which leads to a considerable protrusion on both sides and not infrequently causes injuries upon bathing. For use, the key, which is mounted with the handle side around a pin, must be swung out of the pocket, passing over special detent means, which however requires a certain amount of dexterity of the fingers.

SUMMARY OF THE INVENTION

The object of the present invention is to create a key of the introductory mentioned type which is ready for use without any special measures and is characterized by an extremely simple construction which is favorable for use.

According to the invention the key comprises a strip which is provided with an opening code and can be closed to form an arm band of different diameter. In this completely new development, the strip which forms the arm band is itself the key. The conventional key, which is, as a rule, expensive to manufacture, can be done away with. Instead of this, simply a codable strip is employed. The coding can consist of punched-hole coding or else of a magnetic coating. In this connection one can, in simple manner, start from a tape. Ordinary commercial plastic material wound on supply rolls can suitably be used. It affords the desired resistance to water without any special additional expense. The strip is also sufficiently flexible and resilient. Furthermore, there are no longer any protrusions which extend beyond the width of the strip. In order to obtain the dependable closing of the strip, it is furthermore proposed that the side edges of the strip be provided, at least over a part of their length, with notches arranged in a row, one behind the other, and that a cross slot having slots of correspondingly different length be provided in the opposite end region. In this way, the customary buckle is also done away with. The end having the indented edge is simply pulled through the cross-wise slot of the other end, the notches and the transverse arm of the cross-wise slot interengaging. The strip-key can thus over its entire length fit the slot of a reading device of corrresponding cross section of the lock of the locker door.

BRIEF DESCRIPTION OF THE DRAWINGS

The object of the invention will be explained in further detail below with reference to an embodiment shown by way of example in the drawing, in which:

FIG. 5 is a partial front view looking at a locker door with lock and corresponding reading device; and FIG. 6 is a section along the line VI—VI of FIG. 5.

DETAILED DESCRIPTION OF THE PREFERRED EMBODIMENT

Figures 1, 2, 3, 4:
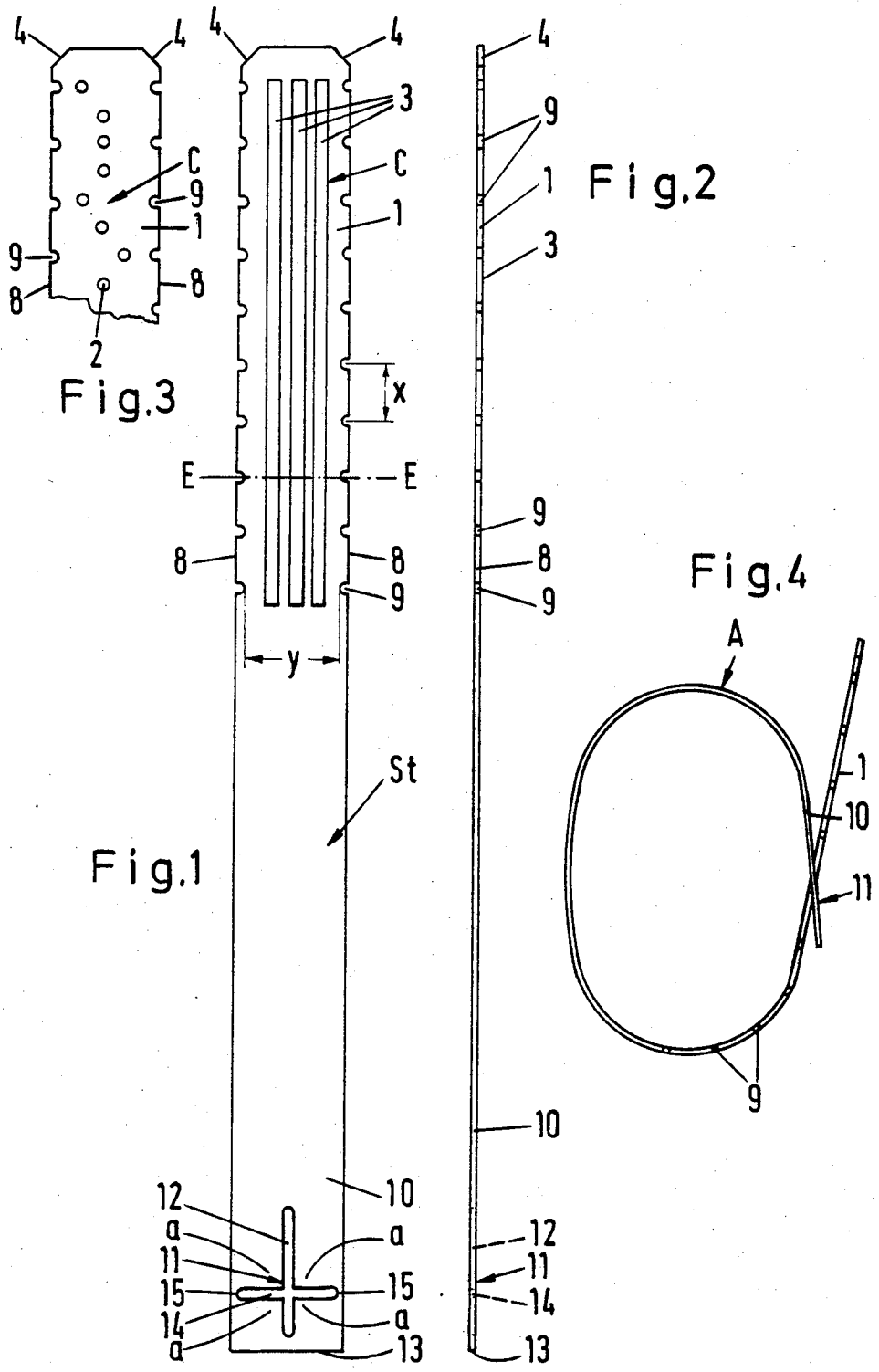
FIG. 1 is a plan view of the key formed by a strip, shown in its extended position.
FIG. 2 is a side view thereof.
FIG. 3 shows a portion of a strip key which has been modified with respect to the means of coding.
FIG. 4 shows the strip closed to form an arm band, seen in side view.

The key comprises a strip St of plastic cut to length. The thickness of the strip is about 1 mm and its width is about 20 mm.

The strip is provided in its one end region with an open coding C, for instance in the form of holes 2 (see FIG. 3). Instead of such holes, the open coding C can also be developed in the form of magnetically coded strips 3, as shown in FIG. 1.

The end region 1 of the strip St which has the open coding C is beveled at the end, or more precisely at the corners, so that there is no danger of injury. Also, due to the corresponding convergence of the oblique edges 4 which are formed by the beveling, the introduction of the strip key into the slot 5 of a reading device 6 is facilitated. The upper end of the slot furthermore terminates in a funnel-shaped centering channel 7.

The strip edge St, which consists of semi-soft plastic, can be brought into the arm-band-like shape shown in FIG. 4, i.e. closed to form an arm band A. This can be done with the production of different diameters so that individual adaptation to the specific wrist or ankle of the bathing guest is possible. For this purpose, the strip St has an edge marking, i.e. the parallel extending side edges 8 of the strip form notches which are open on the edge, arranged in a row, one behind the other. The depth of each notch corresponds approximately to twice the thickness of the strip, as does the width of the notch. The bottom of the notch is rounded. The notches 8 of both side edges lie, in each case, on a common transverse plane E—E. The distance x between the notches in the longitudinal direction of the strip corresponds approximately to the distance between the holes of known buckle straps. The notches, in this case also, extend only over a part of the strip St.

The opposite end region 10 acts as "buckle." Still within the width of the strip, a cross-slit 11 is stamped out here. The longer section 12 of the cross-slit corresponds in length to the width of the strip so that the indented end region of the strip can be conveniently introduced. This cross-slit section 12 extends in the longitudinal central plane of the strip close to the edge 13 of the free end of the strip St. The section 14 of the cross-slit which is crosswise thereto corresponds in its length to the spacing y from the bottom of one notch to that of the next notch of a pair of notches lying on a common transverse plane E—E. There are bridges of material 15 at the side edges 8 which define the corresponding slit ends of the section 14 of the cross-slit; engage in anti-slip fashion the bridges in the corresponding pair of notches 9. This is accomplished by inserting an end region 10 which is turned 90°, starting from the lengthwise position directed in longitudinal direction. The protruding end 1 serves as turning knob. Upon such turning, the angle tabs a produced by the cross-slitting move out of the way and then, when the proper closure position has been reached, spring back again into their initial position, serving as lock. As a result of the cross-slitting, with due consideration of the crossing point which is displaced in the direction of the end edge 13, the tabs lying inward of the strip have greater flexibility than the shorter and accordingly more stable tabs on the other side of the cross-slit section 14. The corresponding complete return into the plane of the strip avoids any catching of the strip key in the shaft 5 of the reading device 6.

The strip St can be pulled entirely through the reading device 6. Depending on the equipment, it can, however, be deemed sufficient if only a part of the strip is inserted for recognition.

The reading device is seated as a projecting structural part on a flange plate 16 of a doorknob 17 and is so connected to the lock 18 that the proper coding causes the actuation of the lock bolt 19.

I claim:

1. A waterproof key, particularly for locks of bathhouse locker doors, which can be worn on the arm of a bathing guest wearer, comprising a strip of material having free ends and an opening code for a lock, said material being sufficiently flexible by a person's hand alone to permit said strip to be bent into an annular form, said material being non-rigid such that itself it is unable to maintain the annular form, said strip being formed with connecting means at its ends for connecting said strip to itself adjacent its ends when the strip is bent into the annular form so as to form an arm band of suitable diameter for encircling the arm of the respective wearer, said connecting means for maintaining the annular form of the strip without permitting the arm band to unintentionally tighten and loosen, respectively.

2. The key according to claim 1, wherein said connecting means comprises, said edges of the strip formed over at least a part of their length with notches arranged in rows adjacent one end of the strip, one behind the other, and in an end region of the strip opposite said one end, a cross slot having intersecting slots of correspondingly different length, said notches of said side edges of the selective row thereof are cooperatively engageable with said cross slot.

3. The key according to claim 2, wherein the thickness and length of one slot of the cross slot is selected for receiving and for engaging the notches of the row of notches to effect closure of the band, said one slot is transverse to a longitudinal direction of said strip.

4. The key according to claim 3, wherein said strip includes coding holes spaced apart from said edges and from and between said notches for functioning independently of said notches.

5. The key according to claim 3, wherein said strip includes magnetically coded strips spaced apart from said edges and from and between said notches for functioning independently of said notches.

6. The key according to claim 2, wherein said intersecting slots of said cross slot comprise a longitudinal slot and a crosswise slot intersecting said longitudinal slot forming first tabs adjacent said crosswise slot between the crosswise slot and said one end of said strip and second tabs adjacent said crosswise slot between the crosswise slot and said end opposite said one end of said strip, said second tabs are more rigid than said first tabs.

7. The key according to claim 6, wherein said longitudinal slot has a length greater than the width of said strip, and said crosswise slot has a length equal to the width of said strip between the notches of a row.

8. The key according to claim 2, wherein the depth and width of each of said notches is approximately equal to twice the thickness of the strip.

9. The key according to claim 1, wherein said strip is uniformly flat throughout its length and slidable completely through the lock.

10. A key comprising a thin strip of material having free ends and an opening code for a lock and able to be pulled completely through the lock, said material being sufficiently flexible by a person's hand alone to permit said strip to be bent into an annular form, said strip being formed with connecting means at its ends for connecting said strip to itself adjacent its ends when the strip is bent into the annular form so as to form an arm band of suitable diameter for encircling the arm of a wearer, said connecting means for maintaining the annular form of the strip without permitting the arm band to unintentionally tighten and loosen, respectively.

* * * * *